US005409164A

United States Patent [19]

Delzenne et al.

[11] Patent Number: 5,409,164

[45] Date of Patent: Apr. 25, 1995

[54] PLASMA CUTTING TORCH

[75] Inventors: Michel Delzenne, Franconville; Andre Borne, Beaumont, both of France

[73] Assignee: La Soudure Autogrene Francaise, Paris, France

[21] Appl. No.: 154,470

[22] Filed: Nov. 19, 1993

[30] Foreign Application Priority Data

Nov. 20, 1992 [FR] France ..... 9213955

[51] Int. Cl.[6] ..... B05B 1/24

[52] U.S. Cl. ..... 239/79; 239/132.3; 239/600

[58] Field of Search ..... 239/690, 708, 79, 80, 239/85, 132.3

[56] References Cited

U.S. PATENT DOCUMENTS

| | | | |
|---|---|---|---|
| 2,960,594 | 11/1960 | Thorpe | 239/79 |
| 3,459,376 | 8/1969 | Haase et al. | 239/132.3 |
| 4,363,443 | 12/1982 | Huehne | 239/79 |
| 4,369,919 | 1/1983 | Beloev et al. | 239/79 |
| 4,688,722 | 8/1987 | Dellassio et al. | 239/132.3 |
| 4,919,334 | 4/1990 | Hartmann et al. | 239/600 |

FOREIGN PATENT DOCUMENTS

| | | |
|---|---|---|
| 2527891 | 12/1983 | France . |
| 2091594 | 8/1982 | United Kingdom . |

*Primary Examiner*—Andres Kashnikow
*Assistant Examiner*—Christopher G. Trainor
*Attorney, Agent, or Firm*—Young & Thompson

[57] ABSTRACT

A plasma cutting torch has a torch body comprising an electrode and a nozzle, and structure for mounting and connecting the torch body. It further comprises a torch support (A) defining a first series of fluid passages (7, 8, 10, 4, 47, 50, 54) connectable to respective circuits of fluids and a first bearing surface (9); a unitary assembly of torch body (B) comprising the electrode (28, 280) and the nozzle (36) and comprising a second series of fluid passages (25, 27, 38, 39, 42, 48, 49, 55, 56) and a second bearing surface (21); and a quick coupling (D) to assemble the assembly of the torch body to the support for the torch body with the first and second bearing surfaces bearing axially against each other and with the passages of the first series communicating with the respective passages of the second series. At least one of the fluid passages of the second series comprises an end portion (40, 58, 59) projecting relative to the second bearing surface (21) and adapted to be received within a recess (3; 47, 54) of the torch support (A) defining a portion of a passage of the first series.

14 Claims, 3 Drawing Sheets

PLASMA CUTTING TORCH

FIELD OF THE INVENTION

The present invention relates to plasma cutting torches, of the type comprising a torch body comprising an electrode and a nozzle, and means for mounting and connecting the torch body.

BACKGROUND OF THE INVENTION

Plasma cutting torches conventionally comprise a monobloc torch body with, to the rear, the connections to fluid supply channels and electrical energy and securement means on a construction or a working machine, and, forwardly, mounting means for the electrode and the nozzle. The disassembly of these torches, for maintenance or replacement of worn or defective parts, requires disassembly and reassembly operations that are long and delicate, which place the production machine out of operation for a long time and which most often require new adjustment of positioning of the torch before returning it to use.

SUMMARY OF THE INVENTION

The present invention has for its object to provide a new structure of torch, of modular conception, permitting a rapid and easy replacement of the torch body and/or of its constituent elements and overcoming the problems of readjustment of positioning after reassembly.

To do this, according to a characteristic of the invention, the torch comprises a torch support defining a first series of fluid passages connectable to respective supply circuits for said fluids and a first bearing surface, a unitary assembly of torch body comprising the electrode and the nozzle and comprising a second series of fluid passages and a second bearing surface, and rapid assembly means to assemble the assembly of the torch body and the torch support with the first and second bearing surfaces bearing axially against each other and with the passages of the first series communicating with the respective passages of the second series.

According to other characteristics of the invention:

- at least one of the fluid passages of the second series comprises an end portion projecting relative to the second bearing surface and adapted to be received in a recess of the support defining a portion of one passage of the first series;
- the first and the second series of passages each comprise:
  - a plasmagenic gas passage,
  - at least one passage for cooling fluid,
- the assembly of the torch body comprises at least one piston displaceable relative to the electrode with respect to the torch, the first and second series of passages each comprising at least one gas passage for actuating the piston,
- the assembly of the torch body comprises a first means for actuation by a fluid protecting the electrode and, preferably, a second actuation means by protection fluid of the nozzle.

BRIEF DESCRIPTION OF THE DRAWINGS

Other characteristics and advantages of the present invention will become apparent from the following description of embodiments, given by way of non-limiting example, with respect to the accompanying drawings, in which.

DETAILED DESCRIPTION OF THE INVENTION

Figure 1:
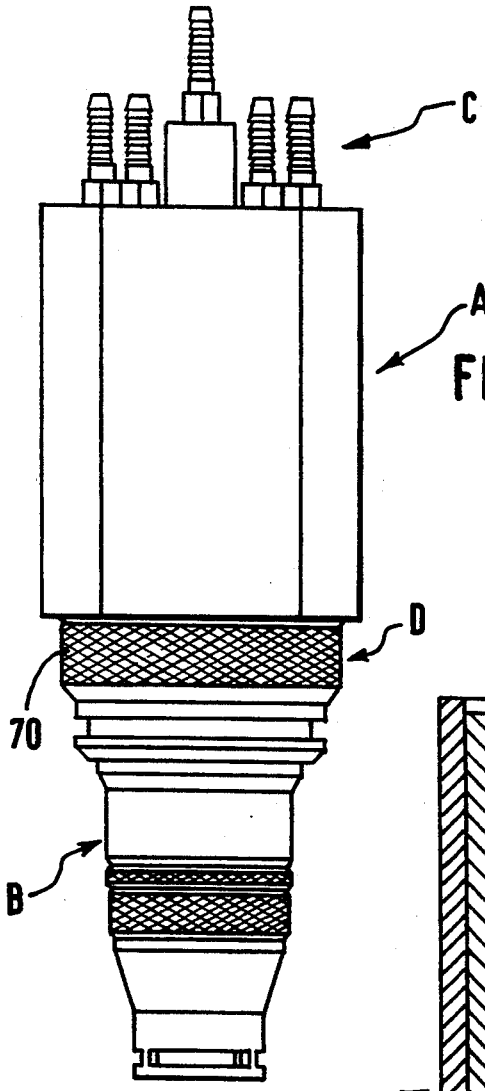
FIG. 1 is a schematic elevational view of a first embodiment of a torch according to the invention.

In the description which follows and in the drawings, the identical or analogous elements bear the same reference numerals, primed as the case may be.

A plasma cutting torch according to the invention comprises generally a torch support A adapted to be mounted on a machine frame and on one end of which is mounted a unitary torch body assembly B, the torch support A comprising, at its opposite end, a series C of elements for connection to fluid passageways and electrical lines.

Figure 2:
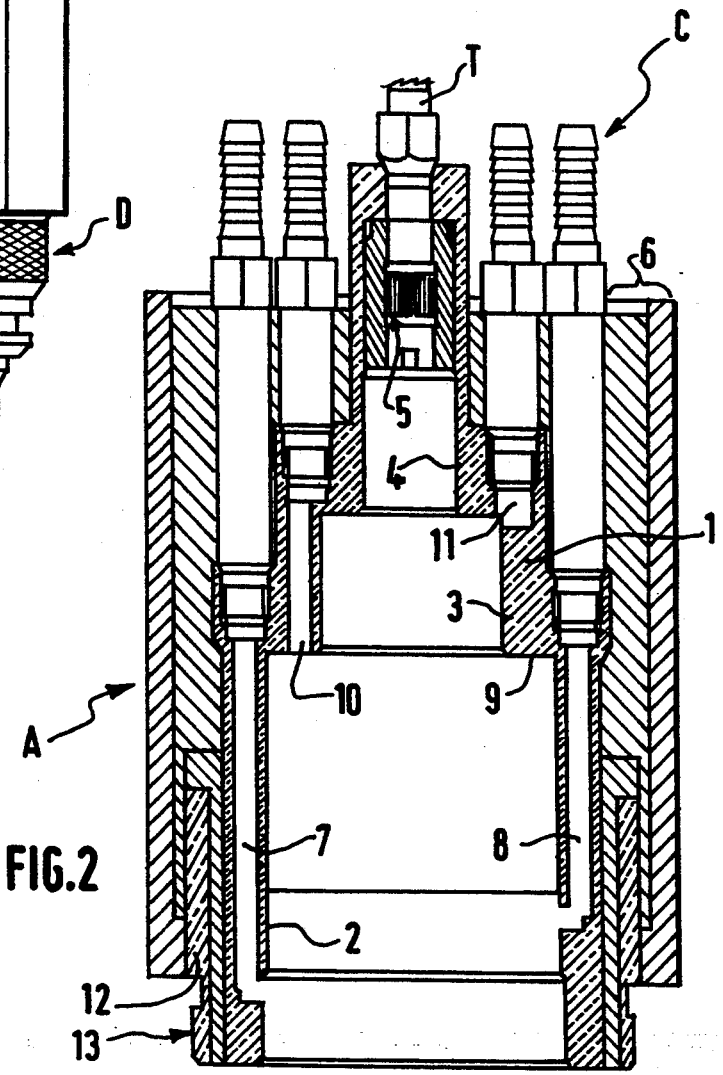
FIGS. 2 and 3 are longitudinal cross-sectional views of the torch support and torch body of the torch of FIG. 1, respectively.
Figure 3:
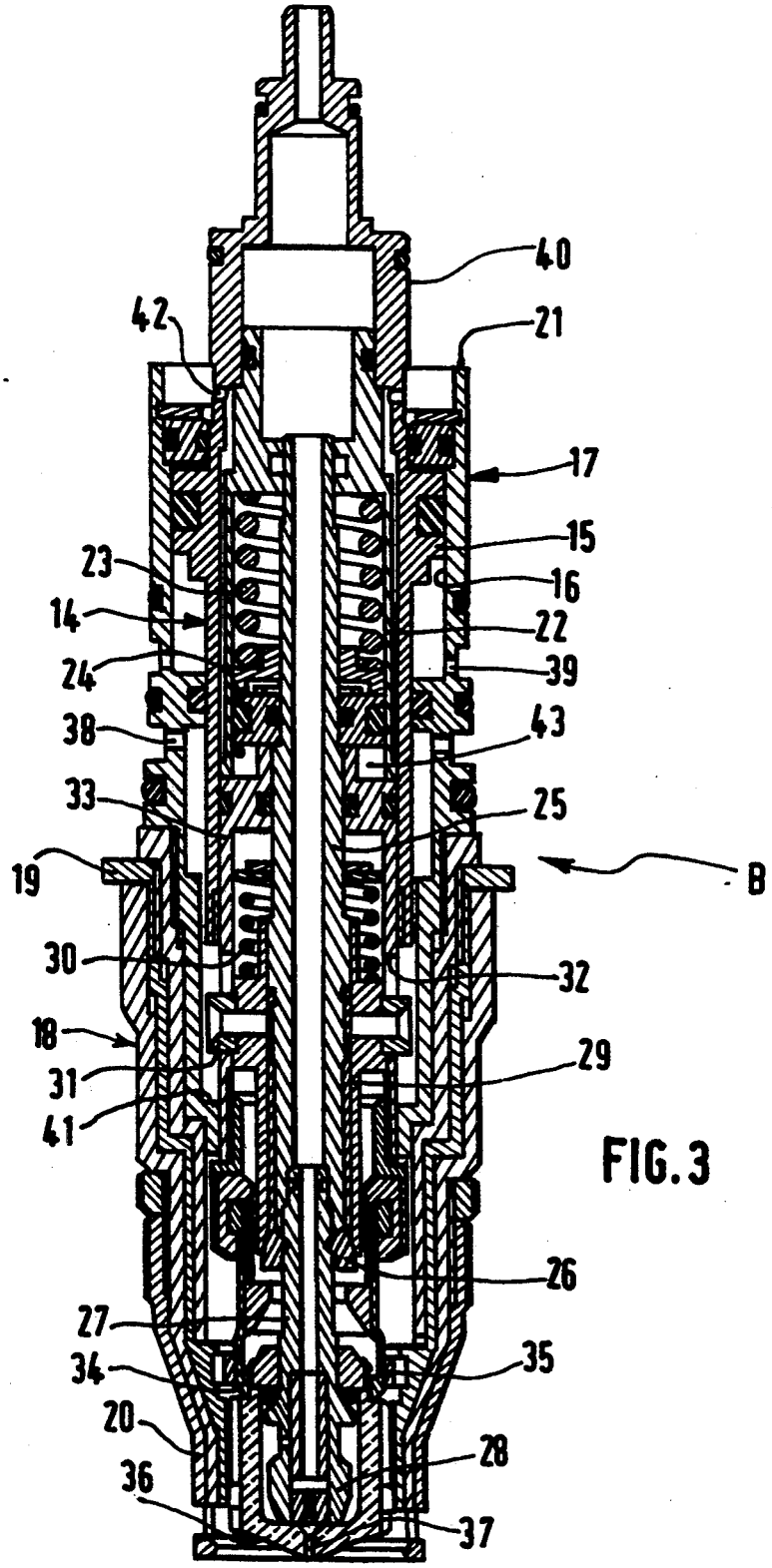

In the embodiment shown in FIGS. 1 to 3, the torch support A comprises a metallic block 1, typically of brass, comprising a succession of stepped bores of different diameters 2, 3, 4, 5 and surrounded by an insulating sleeve 6. Into the bore 2 of largest diameter open a supply passage for cooling gas 7 and a supply passage for actuating gas 8. The connection between the bores 2 and 3 forms an annular transverse surface 9 through which opens a supply passage for a second actuating gas 10. Into the bore 3 opens a passage 11 for supply of a third actuating gas. In the bottom of the bore 4 is mounted an electric contact pin 5, the bore 4 communicating with a tubing T for the supply of plasmagenic gas. The support A comprises, at its forward end, a metallic pin 12 insulated from the block 1 and comprising an external screw thread 13.

As will be seen in FIG. 3, the torch body B comprises a metallic tubular assembly 14 comprising a rear portion forming a piston 15 sliding in an internal bore 16 of a metallic tubular jacket 17 provided with peripheral joints and adapted to be received in the first bore 2 of the torch support A. The jacket 17 is secured to a lower skirt assembly 18 whose upper end forms a collar 19 extending radially outwardly. On the lower end of the skirt assembly 18 is mounted a cap 20. The tubular assembly 14 is rearwardly prolonged by a stepped cylindrical portion adapted to be received sealingly in the rear bores 3 and 4 of the torch support A. The rear end of the jacket 17 forms an annular bearing surface 21 coming into contact against the annular surface 9 of the torch support A. In the tubular assembly 14 is sealingly mounted a tubular element 22 enclosing a spring 23 urging downwardly a piston 24 sliding sealingly in the tubular element 22 and fixed to a hollow rod 25 extending sealingly slidingly within the tubular element 22 and within a tubular prolongation 33 of the assembly 14, and bearing at its lower end a longitudinal flexible gripping tongue structure 26 forming a means for locking and holding a hollow electrode tail 27 bearing at its lower end a hollow electrode 28. The structure of gripper 26 coacts with an external tubular gripping lock 29 slidably mounted on the rod 25 and resiliently urged downwardly by a spring 30. The lock 29 comprises at least one transverse projection 31 passing through an oblong slot 32 formed in the tubular prolongation 33 of the assembly 14 and bearing, at its lower end, a gripping structure 34 with longitudinal flexible tongues coacting with a resilient peripheral ring 35 and forming holding and blocking means for a nozzle 36 into which extends the electrode 28 and provided centrally with an ejection channel for a plasma jet 37.

In the assembled position of the torch body B within the support A, the plasmagenic gas introduced into the bore 4 passes centrally through the body of torch B into an electrode 28 from which it passes to the interior of the torch 36. The cooling gas introduced in the passage 7 penetrates, through transverse openings 38 in the jacket 17, to flow into the skirt 18, about the nozzle 36. A locking gas, introduced through the passage 8, passes through the transverse openings 39 into the bore 16 to press the piston 15 upwardly and to maintain the grippers 26 and 34 in engagement with the electrode tail 27 and with the nozzle 36, respectively. The upper portion 40 of the assembly 14 forms, within the bore 3, an unlocking piston which, when the unlocking gas is introduced into the bottom of bore 3 through the passage 11, presses the assembly 14 downwardly, thus disengaging the gripping structure 34 and the ring 35 and permitting the removal of the nozzle 36. Before the unlocking piston 40 reaches the end of its path, the projections 31 come into abutment against an internal shoulder 41 of the jacket 17, thus freeing the gripper 26 and permitting disengagement of the electrode 28. The electrode 28 is normally maintained pressed against the bottom of the nozzle 36 by the spring 23. To strike the arc, at the beginning of the operation phase, the ignition gas is introduced through the passage 10 and passes, through transverse passageways 42, between the assembly 14 and the assembly 22 until it reaches an annular chamber 43 in front of the piston 24 to urge this latter against the action of a spring 23 and thereby to space the electrode 28 from the nozzle 36 for the purpose, in the first instance, of striking the arc, and then to permit escape of the plasmagenic gas from the interior of the nozzle 36 to the exterior, through the passage 37.

As will be seen in FIG. 1, the torch body B is maintained locked on the support A by a nut 70 coacting with the collar 19 and screwed on threading 13 of the support A, a simple unscrewing of the nut D permitting removal of the assembly of torch body B for rapid replacement of this latter.

In the embodiment of FIG. 4, there is again seen the insulating envelope 6 and the metallic block 1 of the torch support A, which now has a lower flat transverse surface 9 forming a bearing for the bottom 21 of a ball bearing cage 45 forming the rear end of a block 46 of the torch body B which encloses a hollow electrode structure 280 which projects rearwardly and on the lower more forward end of which is mounted the nozzle 36, now surrounded sealingly by a skirt 20' defining a portion of the water cooling circuit, the water being introduced into a longitudinal passage 41 in the block 1, passing through the passage 48 aligned with the passage 47 within the block 46, to the cap 20' to pass via transverse passages 49 to the interior of the electrode structure 280 and to return upwardly of the block 1 through an outlet passage 50. The electrode structure 280 extends upwardly, beyond the surface 21, in a stepped central bore 51 of the block 1 comprising an electric contact pin 52. The electrode structure 280 moreover forms a central intermediate structure of the piston 53 sliding in a central bore of the block 46, the forward surface of the piston 53 receiving, from aligned passages 54 in the block 1 and 55 in the block 46, a trigger gas to space the electrode 280 from the nozzle 36, an extinguishing gas being introduced, through a passage opening at 56 through the rear surface of the piston 53 to return, at the end of the use and at the beginning of reuse, the electrode 280 into contact with the nozzle 36 in which the plasmagenic gas arrives through a passage opening radially at 57 into the nozzle 36.

Figure 4:
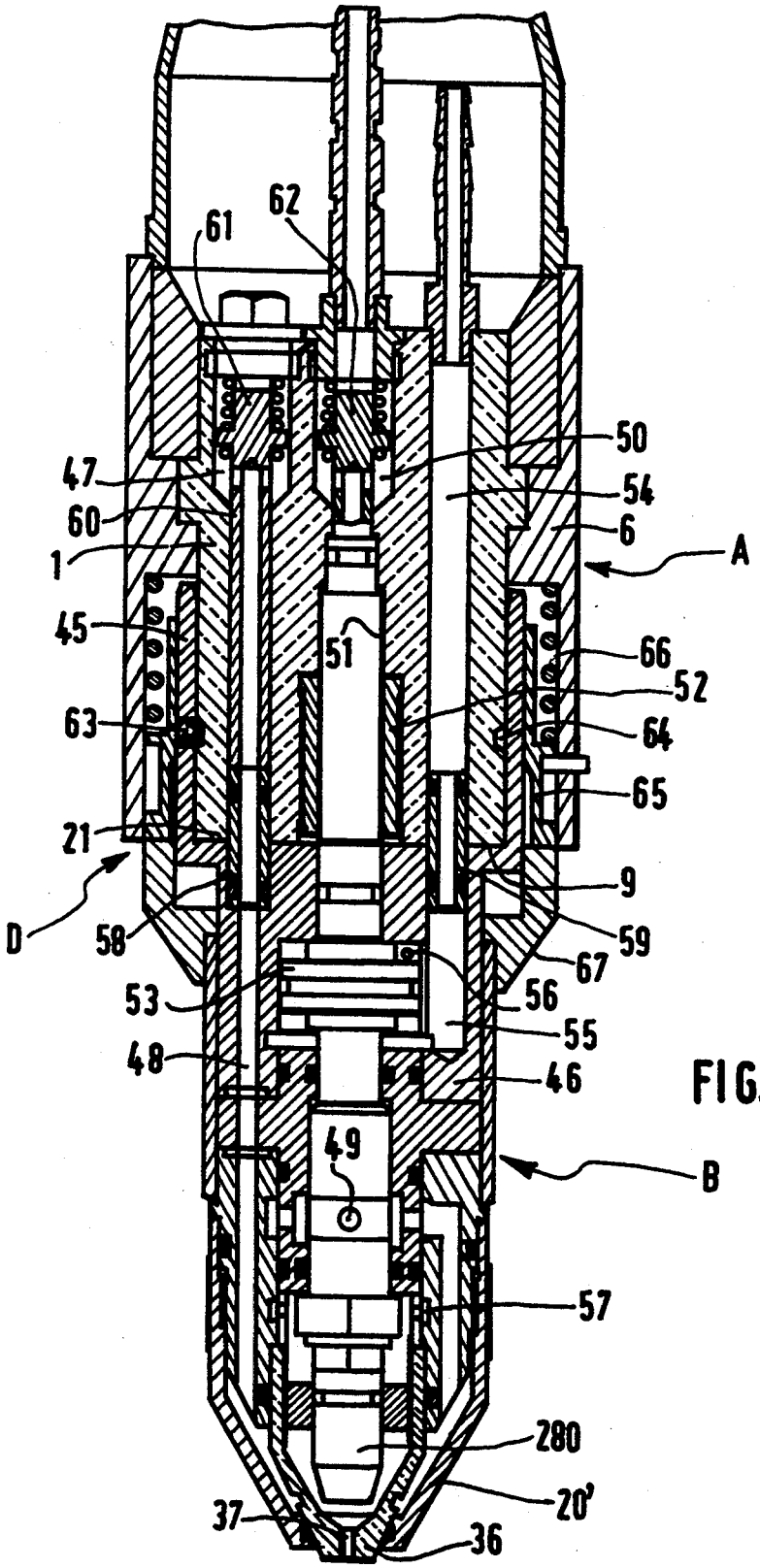
FIG. 4 is a longitudinal cross-sectional view of a second embodiment of a torch according to the invention.

As will be seen in FIG. 4, the fluid passages such as 48 and 55 of the torch body B comprise pins such as 58 and 59 projecting beyond the surface 21 and sealingly received in corresponding passages such as 54 of the torch support. The pin 58 of the cooling water supply circuit coacts with a hollow rod 60 disposed in the water supply passage 47 to open, in use, a closure valve 61 resiliently urged toward a closed position. In like manner, the escape passage 50 for water comprises at its outlet a valve 62 normally urged resiliently toward its closed position and opened, in the assembled condition, by the upper hollow end of the electrode structure 280. In this manner, upon disconnecting the torch body B from the torch support A, the valves 61 and 62 close, thereby avoiding the flow of water from the torch support A.

In the embodiment shown in FIG. 4, the cage 45 carries at least one ball 63 adapted to coact, in a blocked position, with an annular throat 64 formed in the periphery of the forward cylindrical end of the block 1 and with a cylindrical sliding lock 65 forming a ramp, disposed in a forward end chamber of the insulating envelope 6 and urged into locking position by a spring 66. The torch body B comprises a sliding pusher 67 permitting withdrawing the lock 65, against the action of the spring 66, during emplacement by simple plugging in, and the removal of the torch body B.

Although the present invention has been described with respect to particular embodiments, it is not thereby limited but is on the contrary susceptible of modifications and variations which will be apparent to one skilled in the art.

What is claimed is:

1. A plasma torch comprising:

a torch support comprising a first series of fluid passages extending through the torch support and connectable, at one end of the torch support, to fluid supply means, the torch support having a first transverse bearing surface facing opposite said one end of the torch support;

a unitary assembly of a torch body comprising a second series of fluid passages, an electrode, a nozzle at one end of the torch body assembly and a second transverse bearing surface facing opposite said one end of the torch body assembly; and quick coupling means for assembling together the torch support and the torch body assembly with the first and second bearing surfaces being in mutual pressure contact and with the passages of the first series of passages being in tight fluid flow communication with respective passages of the second series of passages.

2. Torch according to claim 1, wherein at least one of the fluid passages of the second series comprises an end portion projecting relative to the second bearing surface and adapted to be received within a recess of the torch support defining a portion of one of said passage of the first series.

3. Torch according to claim 1, wherein the first and second series of passages each comprise a plasmagenic gas passage.

4. Torch according to claim 1, wherein the first and the second series of passages each comprise at least one cooling fluid passage.

5. Torch according to claim 1, wherein the torch body assembly comprises at least one piston for displacement of the electrode relative to the nozzle, the first and second series of passages each comprising at least one passage for gas actuating the piston.

6. Torch according to claim 1, wherein the torch body assembly comprises a fluid actuated means for unlocking the electrode.

7. Torch according to claim 1, wherein the torch body assembly comprises a fluid actuated means for unlocking the nozzle.

8. Torch according to claim 4, wherein the cooling fluid passage of the first series of passages comprises at least one valve actuable by a projecting end portion of one of the passages of the second series of passages.

9. Torch according to claim 1, wherein the quick coupling means comprise a nut.

10. Torch according to claim 1, wherein the quick coupling means are of the quick locking type with a ball bearing cage.

11. A plasma cutting torch, comprising:

a torch support defining a first series of fluid passages connectable to respective circuits of fluids, said torch support having a first bearing surface;

a unitary assembly of a torch body comprising an electrode, a nozzle, a second series of fluid passages, a second bearing surface, and at least one piston for displacement of the electrode relative to the nozzle, said first and second series of passages each comprising at least one passage for gas actuating the piston; and quick coupling means for assembling the assembly of the torch body to the torch support with the first and second bearing surfaces bearing axially against each other and with the passages of the first series communicating with respective passages of the second series of passages.

12. A plasma cutting torch, comprising:

a torch support defining a first series of fluid passages connectable to respective circuits of fluids, said torch support having a first bearing surface;

a unitary assembly of a torch body comprising an electrode, a nozzle, a second series of fluid passages, a second bearing surface, and a fluid actuated means for unlocking the electrode; and quick coupling means for assembling the assembly of the torch body to the torch support with the first and second bearing surfaces bearing axially against each other and with the passages of the first series communicating with respective passages of the second series of passages.

13. A plasma cutting torch, comprising:

a torch support defining a first series of fluid passages connectable to respective circuits of fluids, said torch support having a first bearing surface;

a unitary assembly of a torch body comprising an electrode, a nozzle, a second series of fluid passages, a second bearing surface, and a fluid actuated means for unlocking the nozzle; and quick coupling means for assembling the assembly of the torch body to the torch support with the first and second bearing surfaces bearing axially against each other and with the passages of the first series communicating with respective passages of the second series of passages.

14. Plasma cutting torch, comprising:

a torch support defining a first series of fluid passages connectable to respective circuits of fluids, said torch support having a first bearing surface;

a unitary assembly of a torch body comprising an electrode, a nozzle, a second series of fluid passages, and a second bearing surface, said first and second series of passages each comprise at least one cooling fluid passage, and said cooling fluid passage of the first series of passages comprises at least one valve actuable by a projecting end portion of one of the passages of the second series of passages; and quick coupling means for assembling the assembly of the torch body to the torch support with the first and second bearing surfaces bearing axially against each other and with the passages of the first series communicating with respective passages of the second series of passages.

* * * * *